US011852363B1

(12) United States Patent
Havelick et al.

(10) Patent No.: US 11,852,363 B1
(45) Date of Patent: Dec. 26, 2023

(54) SAFETY SYSTEM FOR VENTING TOXIC VAPORS FROM EXTRACTION SYSTEM

(71) Applicants: Linn D. Havelick, Arvada, CO (US); Joshua J. Glad Felter, Arvada, CO (US)

(72) Inventors: Linn D. Havelick, Arvada, CO (US); Joshua J. Glad Felter, Arvada, CO (US)

( * ) Notice: Subject to any disclaimer, the term of this patent is extended or adjusted under 35 U.S.C. 154(b) by 1041 days.

(21) Appl. No.: 16/675,561

(22) Filed: Nov. 6, 2019

(51) Int. Cl.
*F24F 11/32* (2018.01)
*F24F 110/65* (2018.01)

(52) U.S. Cl.
CPC ..... *F24F 11/32* (2018.01); *F24F 2110/65* (2018.01)

(58) Field of Classification Search
CPC ... F24F 11/32; F24F 2110/65; B01D 11/0288; B01D 11/0296
USPC ..... 454/239
See application file for complete search history.

(56) References Cited

U.S. PATENT DOCUMENTS 3,115,818 A * 12/1963 Smith ..... F24F 9/00 34/92
4,551,314 A * 11/1985 Beckstead ..... C22B 3/28 423/658.5
8,445,034 B1 * 5/2013 Coles, Jr. ..... A61K 31/192 424/725
10,232,286 B1 * 3/2019 Havelick ..... E04H 5/02
10,241,014 B2 * 3/2019 Collins, Sr. ..... B01L 7/52
10,518,301 B1 * 12/2019 Diebold ..... B08B 15/02
2004/0250722 A1 * 12/2004 Kumar ..... B41F 13/00 101/487
2005/0058755 A1 * 3/2005 Chambers ..... A23N 1/003 426/489
2011/0118896 A1 * 5/2011 Holloway ..... G05B 19/0428 700/90
2014/0121391 A1 * 5/2014 Murphy ..... C11B 9/025 554/8
2014/0134938 A1 * 5/2014 Hatton ..... F24F 7/06 454/340
2016/0122685 A1 * 5/2016 Martinsen ..... B01D 11/0261 202/168

(Continued)

FOREIGN PATENT DOCUMENTS

CA 2827447 A1 * 8/2012 ..... B01D 11/0219
CN 109028296 A * 12/2018 ..... F24F 8/10
CN 109028455 A * 12/2018 ..... F24F 11/32

*Primary Examiner* — Edelmira Bosques
*Assistant Examiner* — Frances F. Hamilton
(74) *Attorney, Agent, or Firm* — Edwin H. Crabtree; Ramon L. Pizarro

(57) ABSTRACT

A safety system, under the control of an operator, used for venting toxic or hazardous gas and vapors from a work space. The safety system includes a control system, programmed by a computer, a control panel, a human machine interface (HMI), a gas detector, and an alarm. The HMI is adapted for use by the operator and for operating the safety system. The safety system includes a mechanical solvent, or gas (CO2) based, chemical extraction system, used for extracting oils from oil-bearing plants. The extraction system, comprising a solvent recovery system, is attached to and under the control of the control system. The safety system includes a ventilation system attached to, and under the control of, the control system. The ventilation system is used for venting the gas and vapors from the work space.

11 Claims, 2 Drawing Sheets

(56) References Cited

U.S. PATENT DOCUMENTS

| | | | | |
|---|---|---|---|---|
| 2016/0136541 | A1* | 5/2016 | Jones | B01D 11/0288 422/119 |
| 2016/0228787 | A1* | 8/2016 | Payack | B01D 11/028 |
| 2017/0028315 | A1* | 2/2017 | Baugh | B01D 11/0215 |
| 2018/0038605 | A1* | 2/2018 | Lieberman | B08B 15/02 |
| 2019/0016989 | A1* | 1/2019 | Steele | B01D 11/0296 |
| 2019/0184310 | A1* | 6/2019 | McGrane | B01D 11/0207 |
| 2019/0241536 | A1* | 8/2019 | Durkacz | B01D 11/0203 |
| 2019/0366231 | A1* | 12/2019 | Dooley e | B03C 3/014 |
| 2020/0056115 | A1* | 2/2020 | Vanaman | B01D 11/0257 |
| 2020/0094163 | A1* | 3/2020 | Galyuk | B01D 11/0219 |
| 2020/0116686 | A1* | 4/2020 | Bertini | G01N 33/0006 |
| 2021/0043900 | A1* | 2/2021 | Al-Ghanim | F24F 7/00 |
| 2021/0269737 | A1* | 9/2021 | Wirtz | B01D 11/0273 |
| 2021/0291242 | A1* | 9/2021 | Desrochers | B01L 1/00 |
| 2022/0249977 | A1* | 8/2022 | Seabrook | C07C 37/004 |

* cited by examiner

SAFETY SYSTEM FOR VENTING TOXIC VAPORS FROM EXTRACTION SYSTEM

BACKGROUND OF THE INVENTION

(a) Field of the Invention

This invention relates to a safety system for venting toxic gas and vapors from a work space, and more particularly, but not by way of limitation, to a combination of systems used for detecting toxic gas and vapors and used for venting the toxic or hazardous gas and vapors from the work space. The safety system, in the work space, includes a control system, a mechanical closed loop solvent or gas (CO2) based chemical extraction system, and a ventilation system. The extraction system is used for extracting oils from oil-bearing plants.

Oils found in a variety of plants contain useful chemical compounds that can be utilized for medicine, food, fragrances, and other common household products. Plant oils are typically separated from the plant material using a mechanical, solvent gas-based extraction process. Large scale plant oil extraction operations primarily use solvent based extraction processes, as they are more efficient than using mechanical separation methods.

(b) Discussion of Prior Art

This application incorporates by reference the subject matter found in U.S. Pat. No. 10,232,286, to Linn D. Havelick, Assignee: HAL Extraction Technology, Ltd., Arvada, Colorado 80403.

Heretofore, solvent based extraction systems typically are designed as a closed loop system to recover a solvent after it has been used to separate plant oils from plant material. The closed loop system is necessary, especially when the solvents have toxic or hazardous properties. Common extraction solvents include, but are not limited to, acetone, butane, carbon dioxide, ethanol, hexane, isopropyl alcohol, CO2, N2 and propane.

The most efficient solvents used in oil extraction are dangerous. Safety systems are designed around the extraction process in order to prevent a fire or explosion during normal operation. These safety systems include, but are not limited to, mechanical ventilation systems, gas detection systems, operator alarming systems, fire suppression systems, explosion-proof electronics, interlocked electrical equipment, and battery back-up systems.

An extraction recovery system has certain deficiencies and rarely achieves 100% solvent recovery. A large percentage of the liquid solvent is recovered in the solvent recovery tank. The remaining solvent is often trapped as a low-pressure vapor in each vessel, as a liquid saturated in the fibrous plant material, in a liquid solution with the plant oils and lipids, or a combination of all three. As such, a plant oil extraction process will regularly release flammable or toxic vapors, when any vessel is opened. Obviously, the vapors are inherently dangerous to a system operator.

As mentioned above, the release of flammable or toxic vapors from the closed loop extraction machine is dangerous, but it can be controlled as disclosed herein. A release of gas or vapor from the extraction system occurs when the operator is completing a batch, removing the spent plant material from a leaching vessel, and dispensing the raw oil from a distillation vessel. At this point, the spent plant material and the raw oil can still contain significant quantity of solvent. Since these are routine steps in the extraction process, an operator ultimately has control over the timing and duration of the hazardous environment.

Oil extraction systems that are operated manually rely on the operator's ability to efficiently recover the hazardous solvent, as well as their ability to safely open the system. Because there is a variability between operators and human error, extraction facilities require stringent explosion-proof electrical standards for all equipment used in the extraction process. The explosion-proof electrical components are costly but, will ultimately keep the operator safe, even if an explosive air-fuel ratio is achieved within the extraction work area.

Automated extraction systems, however, can be programmed to control the timing and duration of the hazardous environment. An automated extraction system will be able to calculate the remaining solvent left in the extraction system and prevent an operator from opening vessels before the desired level of solvent is achieved.

Similarly, a mechanical ventilation system can be appropriately sized to handle a pre-determined volume and release of flammable vapor such that an explosive air-fuel ratio is never achieved within the extraction area. If the extraction equipment and surrounding safety systems are designed so that an explosive air-fuel ratio can never be reached, the explosion-proof electrical classification can be rated at a less stringent level. The remaining danger would only be left to catastrophic failure of the extraction equipment. Catastrophic failure of the extraction equipment is an unavoidable danger that is not predictable and already exists for all extraction operations.

Consequentially, an automated extraction system that is communicating with the mechanical ventilation system, gas detection system, fire suppression system and electrical interlocks will remove the variability and consistently provide a safe environment for any operator.

An extraction system interlocked with building controls will be safer for all operators, as the system can anticipate the release of hazardous vapors. The system will be capable of performing interim states, such as heightened ventilation. The system will also be capable of recognizing failures during the extraction process and will be able to respond. Also, the system will be capable of turning off all heating sources and electrical ignition sources during unsafe operations. Further, the safe system will require elevated ventilation rates and reduce utility costs for heating and cooling the air in work area.

The subject safety system, as described herein in a work space, is a combination of a control system operating a mechanical or chemical oil extraction system and a ventilation system. The combination of the three systems is designed to ensure that as a flammable vapor is released from an extraction vessel, the operator will be safe from any hazards generated through the oil extraction process.

SUMMARY OF THE INVENTION

In view of the foregoing, it is a primary objective of the subject invention to provide a safety system and method for venting toxic gas and vapors from a work space when using an oil extraction system. The extraction system is used for extracting oils from oil-bearing plants.

Another object of the safety system is to provide a control system used to control the venting of vapors from the oil extraction system and control a ventilation system used for venting the toxic gas and vapors from the work space.

The subject invention includes a safety system for venting toxic gas and vapors from a work space. The safety system includes a computer programmed control system. The control system is used to operate a closed loop solvent based chemical extraction system. Also, the control system operates a ventilation system for automatically venting the work space when toxic gas and vapors, when released from the extraction system, reach a selected air level, not to exceed 25% LEL or lower explosive limit.

These and other objects of the present invention will become apparent to those familiar with solvent based extraction systems used in plant oil extraction when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject plant oil extraction safety system, and in which.

DETAILED DESCRIPTION OF THE PREFERRED EMBODIMENTS

Figure 1:
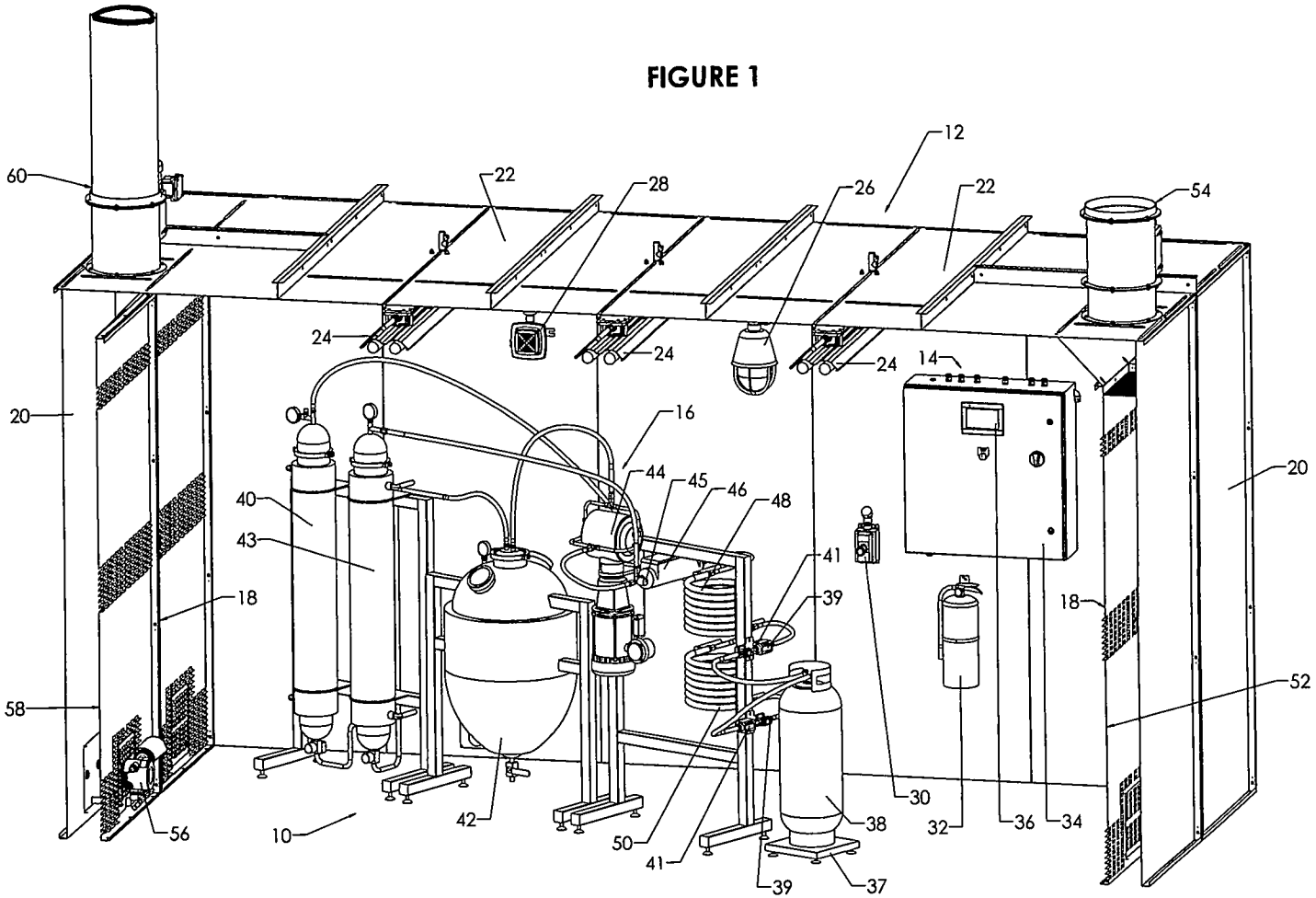
FIG. 1 is a perspective view of a work space including the subject safety system. The safety system includes a control system used for detecting a toxic gas and vapors. The control system is connected to a chemical oil extraction system for extracting plant oils and connected to a ventilation system for venting the toxic gas and vapors from the work space.

In FIG. 1, a perspective view of a work space 10 is shown including the subject safety system, having general reference numeral 12. The safety system 12 includes a control system 14, having general reference numeral 14, used for detecting a toxic gas and vapors in the work space. The control system 14 is connected to a chemical oil extraction system, having general reference numeral 16, used for extracting plant oils, Also, the control system 14 is connected to a ventilation system 18 in the work space 10. The ventilation system 18 is used for venting the toxic gas and vapors from the work space.

The work space 10 can be a laboratory or a booth of different sizes and made up of wall panels 20 and a roof panel 22. The roof panel 22 can include light fixtures 24, a warning light 26 and a warning horn 28. A wall panel 20 can include an emergency button 30 and a fire extinguisher 32. The warning light 26, the warning horn 28, and the emergency button 30 are connected to and operated by the control system 14. The control system is programmed to sound the warning horn 28 and turn on the warning light 26, thus alerting a flammable or toxic gas is present in the work space 10.

The control system 14, programmed by a computer, includes a control panel 34, with a human machine interface (HMI) 36. The HMI 36 is used, by an operator, for controlling the operation of the oil extraction system 16 and the ventilation system 18.

The extraction system 16, programmed through the control system 14, includes a solvent recovery system comprising a solvent recovery tank 38. The tank 38 includes a volume measurement scale 37 for measuring the amount of recovered solvent. Also, the extraction system 16 includes supply and return shut-off valves 39 and flow meters 41, one or more leaching vessels 40, one or more winterization vessels 43, a distillation vessel 42 with heat pump. The solvent recovery system further comprises a solvent recovery pump 44, a solvent filtration vessel 46, a solvent recovery coil 48, and a solvent pre-chiller coil 50. The vessels, pumps, and coils are interconnected with flow lines, flow meters, filters and valves.

In the operation of the extraction system 16, liquid solvent from a solvent storage tank, not shown in the drawings, is used to wash a plant material in the leaching vessel 40, creating a solution comprising of liquid solvent and plant oils. After the solvent has separated the oils from the plant material, the solution is transferred to the winterization vessel 43, with jacketed cooling to freeze and remove plant lipids from the solution. The lipid-free oil-solvent solution is then transferred to the distillation vessel 42. The liquid solvent is then vaporized using a combination of heat in the distillation vessel and a vacuum generated by the solvent recovery pump 44. The pump 44 then moves the pressurized vapor through the solvent filtration vessel 46 and the solvent recovery coil 48, where liquid solvent and is recovered in the solvent recovery tank 38.

It should be noted, the extraction system 16, with sensors, scales, and other measurement devices, can calculate a volume of solvent remaining in the extraction system through the Human Machine Interface (HMI) 36 on the control system 14.

Also, the extraction system 16 is programmed, through the control system 14, to prevent the vessels 40, 42, 43, and 46 from being opened before a desired volume of solvent is recovered within the system. For example, the control system 14 is pre-chiller coil 50. The solvent recovery coil chiller 68 provides for increased recovery of the liquid solvent in the solvent recovery tank 38.

In the operation of the subject safety system 12, an operator will first fill the extraction system 16 with plant material into the leaching vessels 40. At this time, solvent remains in a solvent storage tank.

The operator now uses the HMI 36, on the control system panel 34, to start the automated oil extraction procedure program. Fans in the work space remain turned "on" at a minimum flow rate and wait for any detection of extraction system gas leaks or extraction system failures. Also, the emergency button 30 is on standby. Further, the HMI 36 can be used to control the work space temperature, ventilation fan speed and alarm system status.

The control system 14 now uses the solvent recovery system pump 44 to purge the extraction system 16 of gas and vapors. The inlet shut off valve 39 is now opened and a liquid solvent is transferred from the solvent recovery tank, through the pre-chiller coil 50, into the leaching vessels 40. The control system 14 uses the flow meter 41 to regulate the solvent release rate and measure the total amount of solvent released into the extraction system 16. After the maximum amount of liquid solvent is dispensed into the leaching vessels 40, the control system 14 closes the shut-off valve 39. The liquid solvent can no longer enter the extraction system. As mentioned above, the liquid solvent separates the plant oils from the plant material and combines to form a liquid solution. programmed to calculate the amount of remaining solvent left in the solvent recovery system of the extraction system 16 and prevent the vessels from being opened until a pre-determined maximum quantity of the solvent is left in the system. When the pre-determined maximum quantity of solvent has been recovered, the control system 14 closes the solvent tank's supply shut-off valve 39. The operator can now prepare to open the extraction system's vessels.

Further, the extraction system 16 is programmed to depressurize a flammable or toxic vapor at a pre-determined release rate and safe for the ventilation system 18 to vent the vapor and no greater than a 25% LEL in the work space 10.

The ventilation system 18, under the control of the control system 14, includes a make-up air plenum 52 with air intake vent 54, a gas detector 56, an exhaust plenum 58, and an air discharge vent 60. In operation, the fans in the ventilation system 18 turn "on" at full speed prior to the extraction system 16 depressurizing the flammable or toxic vapors. Additionally, the alarms 26 and 28 will remain "on" until the gas detector 56 reads a value less than 5% of a Lower Explosive Limit (LEL). Also, electrical interlocks will remain off until the gas detector 56 reads a value less than 5% of the LEL.

Figure 2:
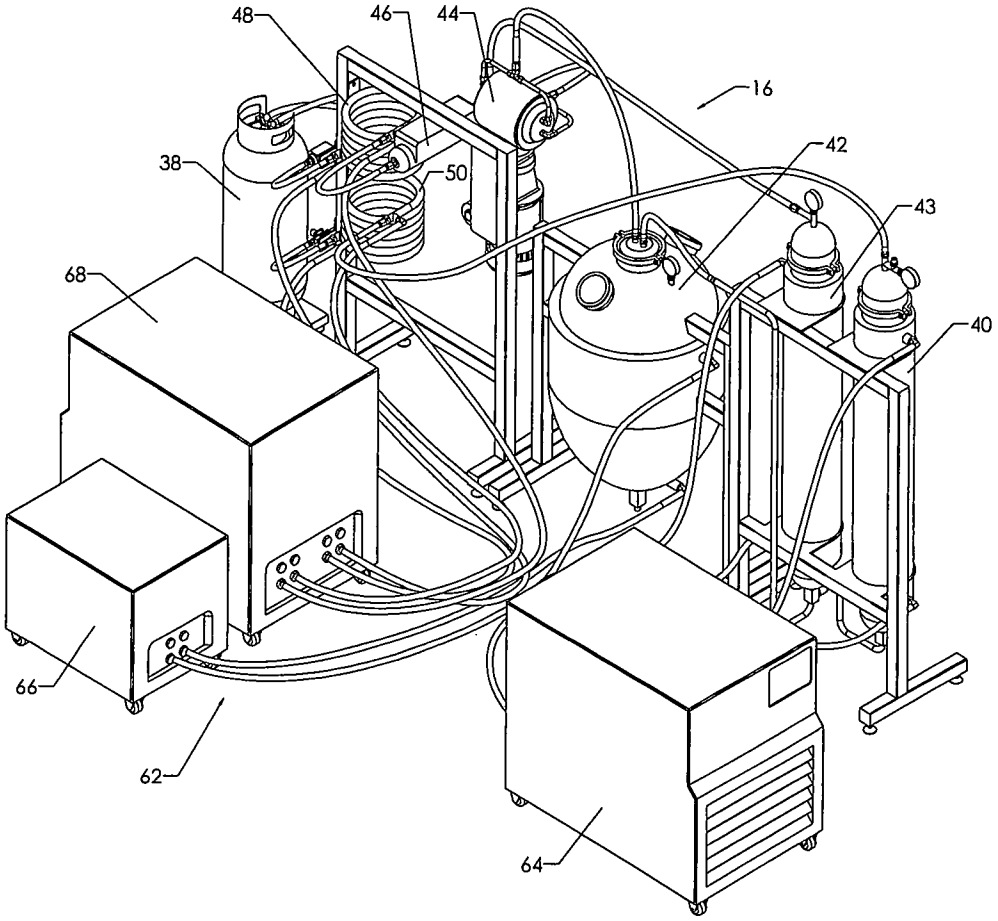
FIG. 2 is a perspective view of a heater and chiller system connected to the oil extraction system and used without an enclosure.

In FIG. 2, is a perspective view of a heater and chiller system is shown and having general reference numeral 62. The heater and chiller system 62 is shown connected to the oil extraction system 16. The heater and chiller system 62 can be used without an enclosure and thus the ventilation system 18 is not required.

The system 62 includes a leaching column chiller 64 connected the leaching vessels 40 and winterization vessels 43. Also, an added heat pump 66 is attached to the distillation vessel 42 for increased heat to the plant oil being distilled therein. Further, a solvent recovery coil chiller 68 is attached to the solvent recovery coil 48 and the solvent A cold refrigerant is now pumped through jackets on the pre-chiller coil 50 and the leaching vessels 40. The control system 14 operates a valve at the bottom of the leaching vessels and the liquid solvent is dumped into the winterization vessel 43 and the liquid solution is held under low pressure and temperature. The lipids in the solution freeze and adhere to the sides of the winterization vessel. The control system 14 operates a valve at the bottom of the winterization vessel 43 and the liquid solution is dumped into the distillation vessel 42, via differential pressure. A heat pump in the distillation vessel 42 is used to circulate warm fluid through jackets in the bottom of the distillation vessel. The control system 14 now turns on the solvent recovery system pump 44 to begin distillation.

The solvent now evaporates in the distillation vessel 42 and is pulled through a hose to the top of the distillation vessel using the solvent recovery system pump 48. At the beginning of the distillation process, a three-way valve 45 on an outlet of solvent recovery system pump 44 is actuated so that pressurized vapor is sent back through the leaching vessels 40 to clear any remaining liquid solution in the leaching and winterization vessels 43. The remaining liquid solution is then transferred to the distillation vessel 42, using the differential pressure created by the pressurized vapor coming from the solvent recovery pump 44.

After all of the liquid has been purged from the leaching vessels 40, the control system 14 actuates the three-way valve 45 and closing off the connection between the solvent recovery pump 44 and the leaching vessels 40. The valve now directs the vapors towards the solvent recovery tank 38 to initiate the recovery process.

The pressurized vapor from the outlet of the solvent recovery pump 44 is now pushed through the solvent filtration vessel 46 and pushed through a solvent recovery coil 48. The control system 14 uses the flow meter 41 to measure the total solvent reclaimed in the closed loop extraction system 16. At this time, pressurized vapor begins to condense as a liquid as it enters the solvent recovery tank 38, as a saturated liquid-vapor mixture.

As mentioned above, a key feature of the subject safety system 12 is the control system 14 is able to calculate the remaining solvent left in the system and prevent the extraction system's vessels from being opened, until a pre-determined maximum quantity of flammable or toxic solvent remains in the extraction system.

Still another key feature of the safety system is when the pre-determined maximum quantity of solvent has been achieved, the control system 14 closes the solvent recovery tank's inlet shut-off valve 39. The operator can now prepare to open the extraction system's vessels.

Also at this time, the operator uses the HMI 38 to acknowledge that the extraction system 16 is ready to be opened, and the safety system 12 prepares for flammable gas and vapors to enter the work space 10. Prior to the extraction system 16 being opened, the mechanical ventilation system 18 is activated at full speed. Also at this time, the control system 14 turns on the warning light 26 and warning horn 28 to send warning signals to all occupants in the work space 10 alerting everyone that flammable gas will be present. Further, the electrical equipment interlocked with the extraction system 16, such as power to heaters, chillers, pumps, electrical outlets, and other hazardous equipment is turned off. With the mechanical ventilation and alarming systems active, the operator can now acknowledge that the extraction system's vessels can be opened. During this time, the mechanical ventilation system 18 and the audio and visual alarms remains "on" until the gas detection system reads a value less than 5% of the Lower Explosive Limit (LEL). Also, the electrical interlocks remain "off" until the gas detector 56 reads a value less than 5% of the LEL.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A safety system, under the control of an operator, used for venting toxic or hazardous gas and vapors from a work space, the safety system comprising:

a control system, programmed by a computer, the control system including a control panel, a human machine interface (HMI), a gas detector, and an alarm, the HMI adapted for use by the operator and for operating the safety system, the gas detector used for detecting gas and vapors in the work space and connected to the alarm for actuating the alarm when the gas and vapors are present in the work space;

an extraction system for extracting oils from oil based plants, the extraction system comprising a mechanical solvent recovery system and attached to and under the control of the control system; and a ventilation system, the ventilation system attached to and under the control of the control system, the ventilation system used for venting the gas and vapors from the work space which are released from the solvent recovery system, the ventilation system programmed to automatically vent the work space when the gas and vapors are released from the solvent recovery system and when a gas and vapor level reaches a selected air level not to exceed 25% of a Lower Explosive Limit (LEL), as indicated by the gas detector;

whereby, during the operation of the safety system, the ventilation system is turned "on" and the alarm is turned "on" and will remain "on" until the gas detector reads a value less than 5% of the LEL and electrical interlocks in the safety system remain "off" until the gas detector reads a value less than 5% of the LEL; and wherein the extraction system is programmed through the control system to prevent at least one of a plurality of vessels of the extraction system from being opened before a desired volume of solvent is recovered in the solvent recovery system.

2. The safety system as described in claim 1, wherein the alarm includes a visual alarm and an audio alarm for alerting occupants when the gas and vapors are present in the work space.

3. The safety system as described in claim 1, wherein the control system is connected to an emergency button used by the operator for shutting down the extraction system.

4. The safety system as described in claim 1; wherein the solvent recovery system includes sensors, scales and measurement devices to calculate a volume of solvent remaining in the extraction system using the HMI on the control system.

5. A safety system, under control of an operator, used for venting toxic or hazardous gas and vapors from a work space, the safety system comprising:

a control system, programmed by a computer, the control system including a control panel, a human machine interface (HMI), a gas detector, and an alarm, the HMI adapted for use by the operator and for operating the safety system, the gas detector used for detecting gas and vapors in the work space and connected to the alarm for actuating the alarm when the gas and vapors are present in the work space;

an extraction system comprising a mechanical solvent recovery system, the extraction system used for extracting oils from oil based plants, the extraction system attached to and under the control of the control system; and a ventilation system, the ventilation system attached to and under the control of the control system, the ventilation system used for venting the gas and vapors from the work space which are released from the solvent recovery system, the ventilation system programmed to automatically vent the work space when the gas and vapors are released from the extraction system and a when a gas and vapor level reaches a selected air level not to exceed 25% of a Lower Explosive Limit (LEL), as indicated by the gas detector;

whereby, during the operation of the safety system, the ventilation system is turned "on" and the alarm is turned "on" and will remain "on" until the gas detector reads a value less than 5% of the LEL and electrical interlocks in the safety system remain "off" until the gas detector reads a value less than 5% of the LEL; and wherein the extraction system is programmed to depressurize flammable or toxic vapors at a pre-determined release rate, thereby safe for the ventilation system to vent the gas and vapors and preventing a LEL greater than 25% of the LEL in the work space.

6. The safety system as described in claim 5, wherein the alarm includes a visual alarm and an audio alarm for alerting occupants when the gas and vapors are present in the work space.

7. The safety system as described in claim 5, wherein the control system is connected to an emergency button used by the operator for shutting down the extraction system.

8. The safety system as described in claim 5, wherein the solvent recovery system includes sensors, scales and measurement devices to calculate a volume of solvent remaining in the extraction system using the HMI on the control system.

9. A method for venting toxic or hazardous gas and vapors from a work space, the steps comprising:

programming a control system in the work space and under an operator control, the control system including a control panel, a human machine interface (HMI), a gas detector, and an alarm, the gas detector used for detecting gas and vapors in the work space and connected to the alarm for actuating the alarm when the gas and vapors are present in the work space;

starting an extraction system comprising a mechanical solvent recovery system, the extraction system under the control of the control system;

extracting oils from oil based plants using the extraction system;

turning "on" a ventilation system prior to opening vessels in the extraction system;

venting gas and vapors from the solvent recovery system using the ventilation system attached to and under the control of the control system and when the gas and vapors level reaches a selected air level not to exceed 25% of a Lower Explosive Limit (LEL), as indicated by the gas detector; and turning the ventilation system "on" and the alarm "on" until the gas detector reads a value less than 5% of the LEL and turning "off" electrical interlocks in the extraction system until the gas detector reads a value less than 5% of the LEL.

10. The method as described in claim 9, further including a step of turning on the alarm, which includes a visual alarm and an audio alarm and alerting occupants when the gas and vapors are present in the work space.

11. The method as described in claim 9, further including a step of turning "on" an emergency button by the operator for shutting down the extraction system.

* * * * *